US010701765B2

(12) United States Patent
McKellar

(10) Patent No.: US 10,701,765 B2
(45) Date of Patent: Jun. 30, 2020

(54) FLEXIBLE CONVERTIBLE HOTPLATE ADAPTER FOR ROUNDED VESSELS AND OBJECTS

(71) Applicant: Bernard Robert McKellar, Dallas, TX (US)

(72) Inventor: Bernard Robert McKellar, Dallas, TX (US)

( * ) Notice: Subject to any disclaimer, the term of this patent is extended or adjusted under 35 U.S.C. 154(b) by 274 days.

(21) Appl. No.: 15/628,095

(22) Filed: Jun. 20, 2017

(65) Prior Publication Data

US 2018/0288831 A1 Oct. 4, 2018

Related U.S. Application Data

(63) Continuation-in-part of application No. 15/246,733, filed on Aug. 25, 2016, now Pat. No. 10,406,526.

(60) Provisional application No. 62/210,112, filed on Aug. 26, 2015.

(51) Int. Cl.

| | |
|---|---|
| ***B01L 3/08*** | (2006.01) |
| ***B01L 9/00*** | (2006.01) |
| ***H05B 3/68*** | (2006.01) |
| ***B01L 7/00*** | (2006.01) |
| ***B01F 13/08*** | (2006.01) |

(Continued)

(52) U.S. Cl.

CPC ..... *H05B 3/68* (2013.01); *B01F 13/08* (2013.01); *B01F 15/065* (2013.01); *B01L 7/00* (2013.01); *B01L 9/00* (2013.01); *B01F 2015/062* (2013.01); *B01L 3/08* (2013.01); *B01L 2300/0803* (2013.01); *B01L 2300/0851* (2013.01); *B01L 2300/123* (2013.01); *B01L 2300/1805* (2013.01); *B01L 2300/1816* (2013.01); *H05B 3/00* (2013.01)

(58) Field of Classification Search

CPC ..... B01L 7/00; B01L 9/00; B01F 13/0818; B01F 15/065; B01F 15/0072; B65D 81/3227; B65D 81/3244; B65D 21/02; B65D 21/0202; B65D 21/0233; H05B 3/68

See application file for complete search history.

(56) References Cited

U.S. PATENT DOCUMENTS

| | | | |
|---|---|---|---|
| 2,607,876 | A | 8/1952 | Bergen et al. |
| 2,988,333 | A | 6/1961 | Mesic |
| 3,784,170 | A | 1/1974 | Peterson et al. |

(Continued)

*Primary Examiner* — Brian R Gordon

(74) *Attorney, Agent, or Firm* — Ice Miller LLP

(57) ABSTRACT

The present invention is an article or device to facilitate the heating of rounded vessels and other rounded objects comprising a flexible polymeric support having a plurality of folds so as to form the flexible polymeric support into a plurality of nested, concentric hollow cylindrical portions whose respective upper edges can be arranged and fixed into two or more configurations to accommodate at least two respective spherical section contours of respective different sizes. The present invention facilitates the heating of rounded, regularly-shaped or irregularly-shaped vessels or objects by presenting a flexible polymeric support surface. The flexible polymeric support surface is sufficiently malleable so as to be adapted for heating such objects or containers, and may be incorporated into an arrangement or system for heating such a container or object, and/or for stirring its contents, while being supported by the article or device of the present invention.

14 Claims, 5 Drawing Sheets

(51) Int. Cl.
*B01F 15/06* (2006.01)
*H05B 3/00* (2006.01)

(56) References Cited

U.S. PATENT DOCUMENTS

| | | | | |
|---|---|---|---|---|
| 3,829,655 | A * | 8/1974 | Thibault | B01L 7/00 219/430 |
| 4,054,270 | A | 10/1977 | Gugger et al. | |
| 4,080,663 | A | 3/1978 | Wik | |
| 4,090,263 | A | 5/1978 | Hoffa | |
| 4,131,370 | A | 12/1978 | Lawrence et al. | |
| 4,199,265 | A | 4/1980 | Sanderson et al. | |
| 4,214,874 | A | 7/1980 | White | |
| 4,227,815 | A | 10/1980 | Hoffa | |
| 4,390,283 | A | 6/1983 | Meyer | |
| 4,568,195 | A | 2/1986 | Herz et al. | |
| 4,752,138 | A | 6/1988 | Rufer | |
| 4,759,635 | A | 7/1988 | MacMichael et al. | |
| 4,830,511 | A | 5/1989 | Smazik | |
| 4,876,069 | A | 10/1989 | Jochimsen | |
| 4,911,555 | A | 3/1990 | Saffer et al. | |
| 4,991,973 | A | 2/1991 | Maaz et al. | |
| 5,529,391 | A | 6/1996 | Kindman et al. | |
| 5,899,567 | A | 5/1999 | Morris, Jr. | |
| 5,911,503 | A | 6/1999 | Braden et al. | |
| D426,312 | S | 6/2000 | Gomes | |
| 6,508,582 | B2 | 1/2003 | Friedman | |
| 6,659,637 | B2 | 12/2003 | Friedman | |
| 6,701,718 | B1 * | 3/2004 | Pisciotta | B01L 7/00 126/383.1 |
| 6,733,171 | B2 | 5/2004 | Schob | |
| 6,905,656 | B1 | 6/2005 | Ladlow et al. | |
| 6,962,433 | B2 | 11/2005 | Nichols et al. | |
| 6,988,825 | B2 | 1/2006 | Coville et al. | |
| 7,075,040 | B2 | 7/2006 | McFadden et al. | |
| 7,153,021 | B2 | 12/2006 | Goodwin et al. | |
| 7,364,350 | B2 | 4/2008 | Coville et al. | |
| 7,494,267 | B2 | 2/2009 | Ware | |
| 8,398,297 | B2 | 3/2013 | Dettling et al. | |
| 2003/0132214 | A1 | 7/2003 | Royer | |
| 2004/0151065 | A1 | 8/2004 | Nichols et al. | |
| 2006/0165851 | A1 * | 7/2006 | Brizio | A47J 31/005 426/106 |
| 2006/0198767 | A1 | 9/2006 | Fordham | |
| 2008/0013400 | A1 * | 1/2008 | Andrews | B01F 13/0818 366/147 |
| 2010/0326980 | A1 | 12/2010 | Shingler | |
| 2011/0038224 | A1 | 2/2011 | Dettling et al. | |
| 2013/0181000 | A1 * | 7/2013 | Miksovsky | A45F 3/20 220/780 |
| 2015/0375224 | A1 | 12/2015 | Liu et al. | |
| 2017/0333916 | A1 * | 11/2017 | Kamees | B01F 13/0818 |

* cited by examiner

FLEXIBLE CONVERTIBLE HOTPLATE ADAPTER FOR ROUNDED VESSELS AND OBJECTS

RELATED APPLICATION DATA

This application is a continuation-in-part of U.S. patent application Ser. No. 15/246,733, filed Aug. 25, 2016, now U.S. Pat. No. 10,406.526, issued Sep. 10, 2019, which claims the priority benefit of U.S. Provisional Application Ser. No. 62/210,112, filed Aug. 26, 2015, both of which are hereby incorporated in their entirety herein by reference.

BACKGROUND

A very common laboratory operation is heating a round-bottomed flask or other round-bottomed vessel. Flasks can be heated with a flame from a burner but this is very hazardous when associated with flammable solvents often found in laboratories. Steam baths are safer but require a source of steam and this method is otherwise usually not favored due to complications from liquid water present in steam lines, the need to drain condensate water from the bath and temperature control limitations.

Most commonly today, round-bottomed vessels are heated either with heating mantles or with a fluid-filled baths placed on electrical heat sources such as hotplates. Heating mantles are typically constructed from woven-glass-fiber fabric and from glass wool stuffing enclosing a resistance wire or other heating element. Usually the heating mantle is constructed to form a rounded pocket and sized to closely fit the contours of a flask of a certain capacity such as 100 ml, 500 mL, 1 L, 20 L, etc. Consequently, a different heating mantle is required for each size of flask which will likely be heated in the course of laboratory operations and thus an investment in a number of heating mantles is often required. In addition, typically required is a voltage regulating device such as a variable transformer in order to regulate the heat output of the heating mantle. Adjusting such a device to the proper voltage output to achieve a steady temperature is often a matter of trial-and-error. To automatically maintain a temperature set-point may require an additional, separate piece of equipment. To magnetically stir the contents of the round-bottomed flask requires a rotating-magnet device placed under the heating mantle and a magnetic follower in the vessel. However, even with such an arrangement of rotating-magnet device, heating mantle and magnetic follower, satisfactory stirring can fail as the thickness of the heating mantle will separate the rotating magnet from the magnetic follower to the extent that interaction and synchronization of the two magnets is poor.

A fluid-filled bath set on a hotplate can serve as a medium of heat conduction between a flat heating surface and a round-bottomed vessel placed in the bath. Temperature control is usually simpler than with a heating mantle since hotplates often feature digital temperature controls and a thermocouple probe which may be placed in the fluid-filled bath or in the vessel, itself. The bath may be filled with several types of fluids but silicone oil is preferred since it is non-flammable and can be found in grades which are both high boiling and have high decomposition temperatures. The negative aspects of using an oil bath include the following: spillage, the need to adjust of the bath oil level for the displacement of different sized vessels and the need to adjust fluid levels for optimal magnetic stirring height. Any water contamination of the oil will cause oil spattering when the bath is later heated above the boiling point of water. Spillage can occur due to moving and storage of liquid-filled vessels, tipping of fluid-filled baths on jacks or platforms, overflowing due to the thermal expansion of the liquid, cracking or breaking of glass baths and so forth.

Aluminum blocks are found which are formed with both bowl-shaped cavities to receive rounded vessels and with flat bottoms to sit flat on a hotplate. Like heating mantles these aluminum heating blocks are specifically sized for each size of vessel and thus a considerable cost is incurred in obtaining several heating blocks for several different sizes of vessels. Devices which integrate heating blocks with hotplate-type controllers are also available and are purportedly able to accommodate up to three sizes of round vessels. But their utility is typically limited to rounded vessels, because, lacking a flat heating surface, they typically cannot be used as a typical hotplate is used.

Consequently a device is needed which will sit on a hot plate device and transmit heat to a round-bottomed vessel or other rounded apparatus. Further it is desirable for such a device to allow magnetic stirring of the contents of the vessel by means of a magnetic follower placed in the flask. Further it is desirable that such a device be easily adaptable to round bottomed vessels of various sizes and that it be relatively inexpensive to manufacture and easy to use.

SUMMARY OF THE INVENTION

The present invention is a variant of that disclosed in U.S. patent application Ser. No. 15/246,733, filed Aug. 25, 2016, and of U.S. Provisional Application Ser. No. 62/210,112, filed Aug. 26, 2015, both of which are hereby incorporated in their entirety herein by reference. The present invention may be used in place of the concentric ring construction disclosed therein, and otherwise optionally with the heating and stirring elements disclosed therein.

The present invention may be described as a device to facilitate the heating of rounded vessels and other rounded objects comprising a flexible polymeric support comprising a plurality of nested, concentric hollow cylindrical portions each having respective upper edges and adapted to be arranged and fixed in at least two configurations such that the upper edges of the concentric hollow cylindrical portions accommodate at least two respective bowl-shaped contours. The flexible polymeric support may comprise an upper side adapted to contact a container of one of the at least two bowl-shaped contours and a lower side opposite the upper side, and additionally comprising a container disposed on the lower side of the flexible polymeric support, the container containing a thermally conductive fluid.

In some embodiments, the concentric hollow cylindrical portions may comprise a heat-conducting polymeric material selected from the group consisting of heat-conducting silicone rubbers.

The device may additionally comprise a mechanism for creating a rotating magnetic field for purposes of stirring a vessel containing a magnet and disposed on the contour formed by the concentric hollow cylindrical portions. The device also may additionally comprise a thermometer, thermocouple or other temperature-sensing device and an orifice or adaptation to attach a temperature-sensing device.

The present invention also may be described as a device to facilitate the heating of rounded vessels and other rounded objects comprising a flexible polymeric support comprising a plurality of nested, concentric hollow cylindrical portions each having respective upper edges and adapted to be reversibly moved from a collapsed configuration wherein the upper edges are substantially coplanar to a fixed configuration such that the upper edges of the hollow cylindrical portions accommodate the shape of a bowl-shaped contour. The flexible polymeric support may comprise an upper side adapted to contact a container of the bowl-shaped contour and a lower side opposite the upper side, and additionally comprising a container disposed on the lower side of the flexible polymeric support, the container containing a thermally conductive fluid.

The present invention also may be described as a device to facilitate the heating of rounded vessels and other rounded objects comprising a flexible polymeric support comprising a plurality of nested, concentric hollow cylindrical portions each having respective upper edges and adapted to be reversibly moved between two (or more) deployed configurations such that the upper edges of the hollow cylindrical portions accommodate respectively the shapes of at least two (or more) different bowl-shaped contours. The flexible polymeric support may comprise an upper side adapted to contact a container of one of the at least two (or more) bowl-shaped contours and a lower side opposite the upper side, and additionally comprising a container disposed on the lower side of the flexible polymeric support, the container containing a thermally conductive fluid.

The present invention also may be described as a device to facilitate the heating of rounded vessels and other rounded objects comprising a container presenting a flexible polymeric support surface, the container containing a malleable material selected from the group consisting of liquids, pastes, putties, greases, gums or other fluids, such that the flexible polymeric support surface is sufficiently malleable so as to be adapted for the heating of objects or containers selected from the group consisting of rounded containers and objects and other rounded, regularly-shaped or irregularly-shaped objects and containers.

The flexible polymeric support surface of this embodiment may comprise a thermal interface silicone rubber selected from the group consisting of silicone rubber compositions and fluoro-silicone rubber compositions containing substantially-uniform dispersions of filler particles chosen from thermally-conducting metals, minerals, ceramics or other inorganic or organic materials.

The malleable material of this embodiment may be selected from the group consisting of high-temperature-resistant thermal-transfer fluids (e.g., such as Paratherm (Paratherm Corp.), Dowtherm (Dow Chemical Corporation), and Therminol (Eastman Chemical Co.); silicone oil thermal transfer fluids (e.g., such as Syltherm XLT HTF, Syltherm 800 Stabilized HTF, Syltherm HF HTF, (all commercially available from Dow Chemical Company)) and silicone fluids, silicone greases and other silicone materials containing a substantially-uniform dispersion of substantially thermally-conducting filler particles such as those selected from particles of heat-conducting metals, mineral particles, ceramic particles, and inorganic or organic materials.

This embodiment of the device may constructed so to form an object or article which is substantially flat on one face and which is, on the opposite face, substantially shaped to form a pocket, socket, depression or basin such as may conform to the profile of a round-bottomed vessel or to the shape of some other rounded or regularly or irregularly shaped object situated or nested in the pocket.

This embodiment of the device may constructed so to comprise concentric circular pleats or folds in the skin of the flexible polymeric support surface such that a pocket of a certain size and shape is formed as a result of one or more of the pleats/folds being substantially tightly folded-in on itself simultaneous with one or more of the other pleats/folds being substantially unfolded; the device thereby being transformable from accommodating a round-bottomed flask of one capacity to then being reversibly transformed to accommodate a round-bottomed flask of a different capacity. In some embodiments, the flexible pleats or flutes or foldable bands in its skin such that in transforming the device to accommodate round-bottomed flasks of differing capacities the total volume of the device shall remain substantially unchanged even as, simultaneously, the height and diameter/width of the device or article may be changed.

In some embodiments, the device may be transformable to accommodate round-bottomed flasks of two, three or four different capacities. For instance, the device may comprise five concentric pleats or folds in one face such that a single device is transformable to accommodate a 100 mL flask by the substantial unfolding of the two innermost pleats while the three outermost pleats are substantially folded and is transformable to accommodate a 250 mL flask by the substantial unfolding of the second and third innermost pleats while the first innermost pleat and the two outermost pleats are substantially folded and is transformable to accommodate a 500 mL flask by the substantial unfolding of the third and fourth innermost pleats while the first and second innermost pleats plus the outermost pleat are substantially folded and is transformable to accommodate a 1000 mL flask by the substantial folding of the innermost two pleats while the outermost three pleats are substantially unfolded.

A device of the many embodiments of the present invention may additionally comprising handle portion. In some embodiments, the device may additionally comprise a rigid or semi-rigid part which may be used as a handle to lift or carry the device.

In other embodiments, the device may additionally comprise a circular band of rigid or semi-rigid material attached to (or near) the device's upper face with the band's diameter parallel with the device's upper face in a manner useful for uniformly folding or unfolding the concentric circular pleats of the device.

In still other embodiments, the device may additionally comprise a partial covering of a second skin or shell, exterior to the first skin or shell, which is substantially thermally-insulating and which is substantially thermally stable at temperatures of 100° C. or greater.

In still further embodiments, the device may additionally comprise a hole, socket, clip or other feature connecting, retaining, or integrating a thermometer, thermocouple or other temperature measuring or heat measuring instrument.

In other embodiments, the device may additionally comprise a flexible polymeric support surface molded to cast the contours of the lowest section of a Thiele tube, or otherwise shaped in a manner so as to be adapted heating and supporting a Thiele tube.

BRIEF DESCRIPTION OF THE FIGURES

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF VARIOUS EMBODIMENTS OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
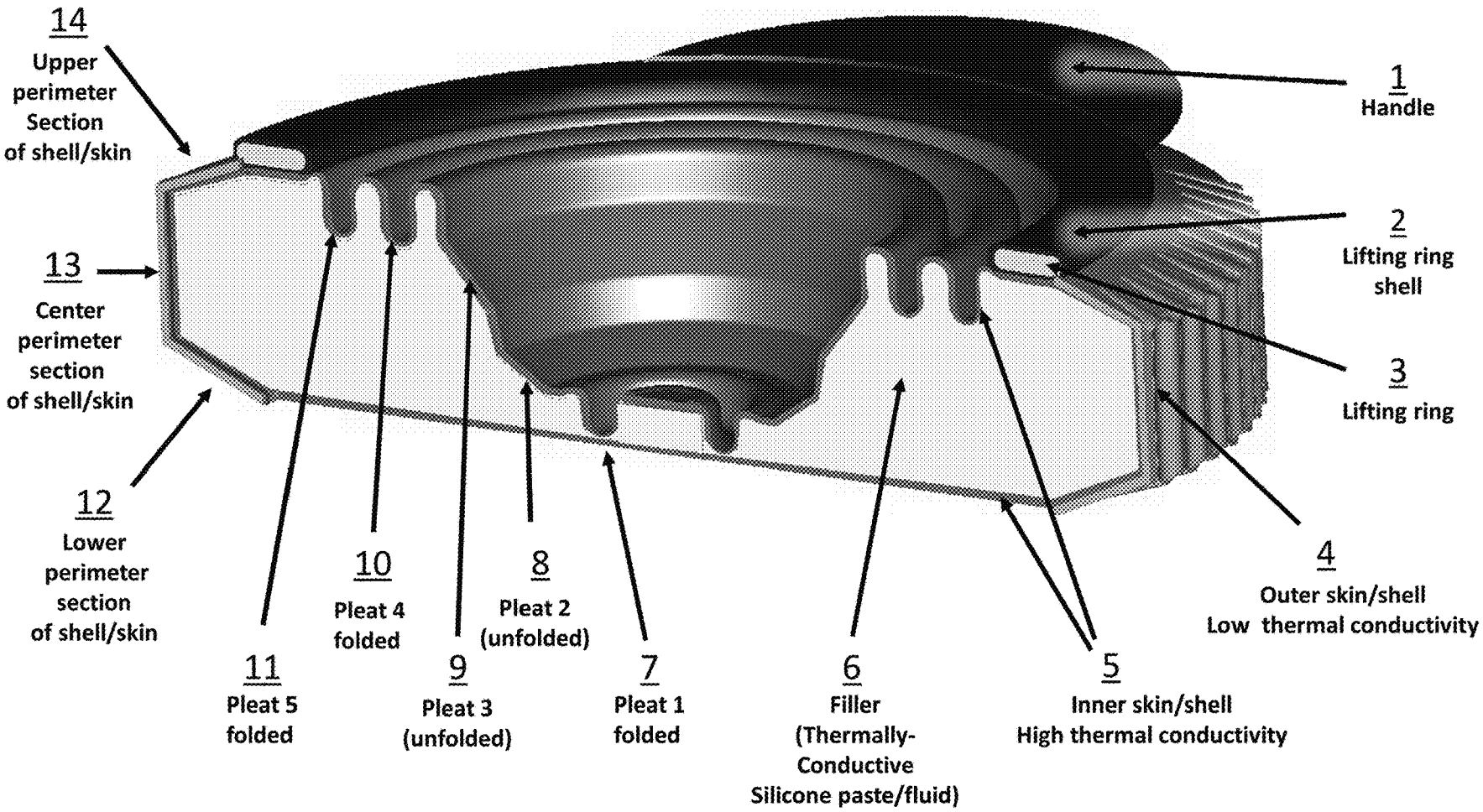
FIG. 1 is a sectioned lateral perspective view of a convertible hotplate adapter in accordance with aspects of the present invention, in a deployed configuration.

FIG. 1 illustrates one embodiment of the present invention as shown in a cut-away, cross-sectional view. In this embodiment, the invention device comprises a flexible skin or shell, 5, filled with a liquid, paste, putty, grease, gum or other malleable substance 6.

The materials of construction of both the skin 5 and the filler substance 6 are chosen from materials which are resistant to substantial degradation when exposed to the range of temperatures the device is expected to experience in normal use; that is, comprising materials which substantially retain their mechanical properties up to temperatures of about 180° C. or greater for practical periods of time. The material of constructions for 5 is chosen from soft, malleable or flexible metals or metal alloys or chosen from high-temperature-resistant organic polymers such as polyimide films. One type of high-temperature-resistant polyimide film is known by the trade name: Kapton (DuPont Chemicals). Most preferentially, the material of construction of 5 is a silicone rubber or a fluorosilicone rubber and, further, 5 preferentially comprises a silicone rubber with superior thermal conductivity, in other words, a material with superior heat conductivity properties. Examples of high-temperature-resistant materials of this type are known in the art as thermal interface silicone rubbers and are materials chosen from various silicone rubber compositions containing substantially-uniform dispersions of filler particles chosen from thermally-conducting metals, minerals, ceramics or other inorganic or organic materials. The chosen thermal interface silicone rubber, preferentially, will have a thermal conductivity greater than 1 W $m^{-1}$ $K^{-1}$. In one embodiment the skin/shell, 5, thickness is in the range of about 0.1 mm to 15 mm but preferentially it is about 2 mm in thickness.

The composition of the moldable/malleable/fluid filler material 6 is to be chosen from high-temperature-resistant thermal-transfer fluids, some examples of which are known by the trade names of Paratherm (Paratherm Corp.), Dowtherm (Dow Chemical Corporation), and Therminol (Eastman Chemical Co.). Still other high-temperature-resistant thermal transfer fluids and materials are known to persons skilled in the art. The preferred moldable/malleable filler substance is a silicone oil such as Syltherm XLT HTF, Syltherm 800 Stabilized HTF, Syltherm HF HTF, (all marketed by Dow Chemical Company) or a silicone fluid, silicone grease or silicone paste and, further, 6 is preferentially a silicone oil, a silicone fluid, a silicone grease or a silicone paste containing a substantially-uniform dispersion of substantially thermally-conducting filler particles such as are chosen from particles of various metals, mineral particles, ceramic particles or other inorganic materials. A silicone paste with continuous thermal stability to 200° C. and very high thermal conductivity is marketed under the trade name Omegatherm 201 by OMEGA Engineering, Inc. Heat-Away 6400 is a high-temperature thermally conductive, copper-filled silicone grease marketed by Aremco Product, Inc. and suitable for heat transfer applications from −51° C. to 288° C. Still other suitable high-temperature thermally conductive fluids, pastes or greases are known to persons skilled in the art.

In one embodiment, the device is constructed to form an object or article which is substantially flat on one face (designated as the bottom) and is substantially shaped, on the opposite face, (designated as the top) to form a pocket, socket, cavity or basin such as may conform to the profile of a round-bottomed vessel or to the shape of some other rounded or regularly or irregularly shaped object to be situated or nested in the pocket.

Another embodiment is also shown in FIG. 1. In this embodiment, the device substantially forms the contours of a truncated cylinder in its overall shape and is substantially flat on one face of the cylinder (designated as the bottom). In this embodiment of the present invention, the device may be reshaped or transformed from being adapted to accommodate a flask of one of four different capacities, either 1.0 L, 500 mL, 250 mL, or 100 mL to then, reversibly, be reshaped or transformed to accommodate a flask of one of the remaining three capacities. For example, the device adapted to accommodate a 1.0 L capacity flask may be changed to accommodate a flask of 500 ml capacity and then reversed to again accommodate a 1.0 L flask. This embodiment of the present invention comprises five concentric circular pleats or flutes (7, 8, 9, 10, 11) which are formed as folds in the skin 5 of the top face of the device such that a basin or crater of a certain size and shape is formed as a result of a process whereby one or more of the pleat/flutes is substantially tightly folded-in on itself and whereby, simultaneously, one or more of the other pleats/flutes is substantially opened or unfolded. Viewing the device as truncated cylinder, the circumferential edge profile comprises a lower lateral circumferential segment, 12, of about 1.0 in in width, a center circumferential segment, 13, of about 1.5 inches in width and an upper lateral circumferential segment, 14, of about 1.0 in in width. The skins or surfaces of the three circumferential segments 12, 13, 14, are substantially folded, forming, within each, one or more pleats or flutes, preferably, with the longer aspect of each pleat or flute oriented perpendicular to the circumference of the cylindrical shape of the device. The angles formed by intersection of the upper circumferential segment, 12, and lower circumferential segment, 14, with the center circumferential segment 13, and, in turn, the angle formed by intersection of the upper circumferential segment with the top face and the intersection of the lower circumferential segment with the bottom face, are changeable by compressing (squeezing) or relaxing the center circumferential wall.

Viewed as a cylinder, changing the device's diameter by compression of (squeezing) the side(s) of the device will cause the incompressible filler fluid to push the top face up and away from the bottom face. In other words, the height of the device will vary inversely with its diameter because the volume of the device will remain essentially constant even as the device is adjusted to accommodate flasks of different capacities.

This embodiment of the present invention further comprises a lifting ring, 3, (FIG. 1). The lifting ring is substantially flat and circular with a thickness of about 4 mm, an inner diameter of about 140 mm and an outer diameter of about 170 mm. The lifting ring is attached to the skin or shell 5 with its center located at the center of the top face. The composition of the lifting ring 3 is chosen from materials which are both substantially ridged and which are substantially thermally stable at temperatures of 150° C. or greater. Materials of construction for the lifting ring are chosen from metals, glass-fiber-reinforced phenolic resin composites, ceramics and from other suitable materials known to persons skilled in the art. The lifting ring, 3, is attached by means of rivets or other mechanical fasteners or it is attached by means of an adhesive, the adhesive being stable to the elevated temperatures expected to be experienced by the device. Alternatively, the lifting ring, 3, may be encapsulated within, or otherwise integrated with the skin of the device.

Figures 2A, 2B, 2C, 2D:
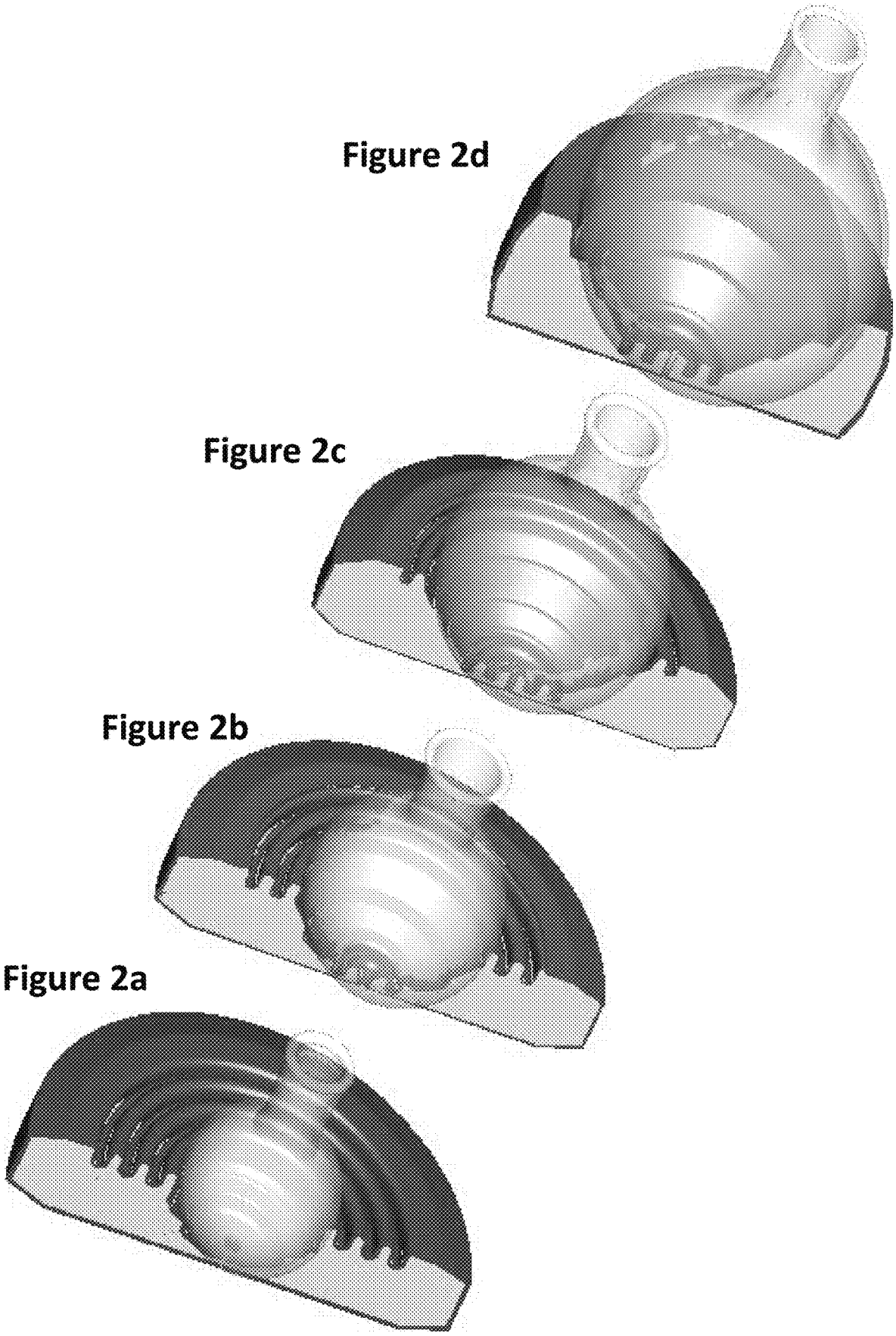
FIGS. 2*a* through 2*d* are top sectioned perspective views of a convertible hotplate adapter in accordance with aspects of the present invention, and show in respective deployed configurations.

FIGS. 2*a*, 2*b*, 2*c*, and 2*d* illustrate four modalities or transformations of one embodiment the present invention rendered in four cross-sectional views. FIG. 2*a* illustrates one modality or transformation of the present invention adapted to accommodate a 100 mL flask by the substantial unfolding of pleats 1 and 2 while pleats 3, 4 and 5 are substantially folded. FIG. 2*b* illustrates another modality or transformation of the present invention adapted to accommodate a 250 mL flask by the substantial unfolding of pleats 2 and 3 while pleats 1, 4 and 5 are substantially folded. FIG. 2*c* illustrates still another modality or transformation of the present invention adapted to accommodate a 500 mL flask by the substantial unfolding of pleats 3 and 4 while pleats 1, 2 and 5 are substantially folded. FIG. 2*d* illustrates still another modality or transformation of the present invention adapted to accommodate a 1000 mL flask by the substantial folding of pleats 1 and 2 while pleats 3, 4 and 5 are substantially unfolded.

In one embodiment, the lifting ring 3, is encapsulated by a coating, designated as the lifting ring shell, 2, (FIG. 1) which is about 2 mm in thickness. The composition of the lifting ring shell ring shell 2 is chosen from, thermally-stable materials and preferentially, it comprises a material with relatively low thermal conductivity such as a silicone rubber which contains no thermally-conductive filler material. One purpose for the lifting ring shell is to provide insulation and a cooler surface to touch with the hand. Attached to or integrated with the lifting ring are two or more handles, for example, 1, (FIG. 1). In one embodiment the handle, 1, is an expanded region of the lifting ring extending beyond the lateral margins of the top face of the device. The purpose of the lifting ring is to provide a place for attachment of the handle or handles, and, in addition the lifting ring facilitates the adjustment of the device to flasks of different capacities by facilitating the opening (unfolding) and closing (folding) of the concentric pleats.

In one embodiment, the device or article comprises a partial covering of a second skin or shell, 4, (FIG. 1) exterior to the first skin or shell, which is substantially thermally-insulating and which is substantially thermally-stable at temperatures of 100° C. or greater.

Figure 3B:
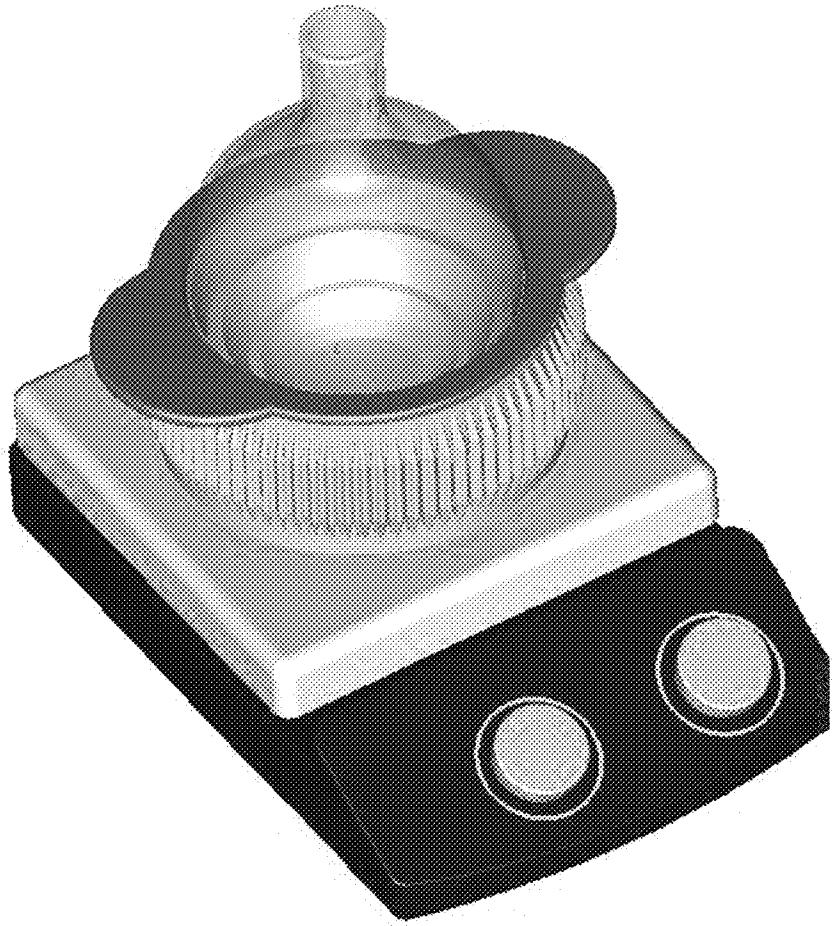
FIGS. 3*a* and 3*b* are top perspective views of a hotplate bearing a convertible hotplate adapter in accordance with aspects of the present invention, with the convertible hotplate adapter shown in respective deployed configurations.
Figure 3A:
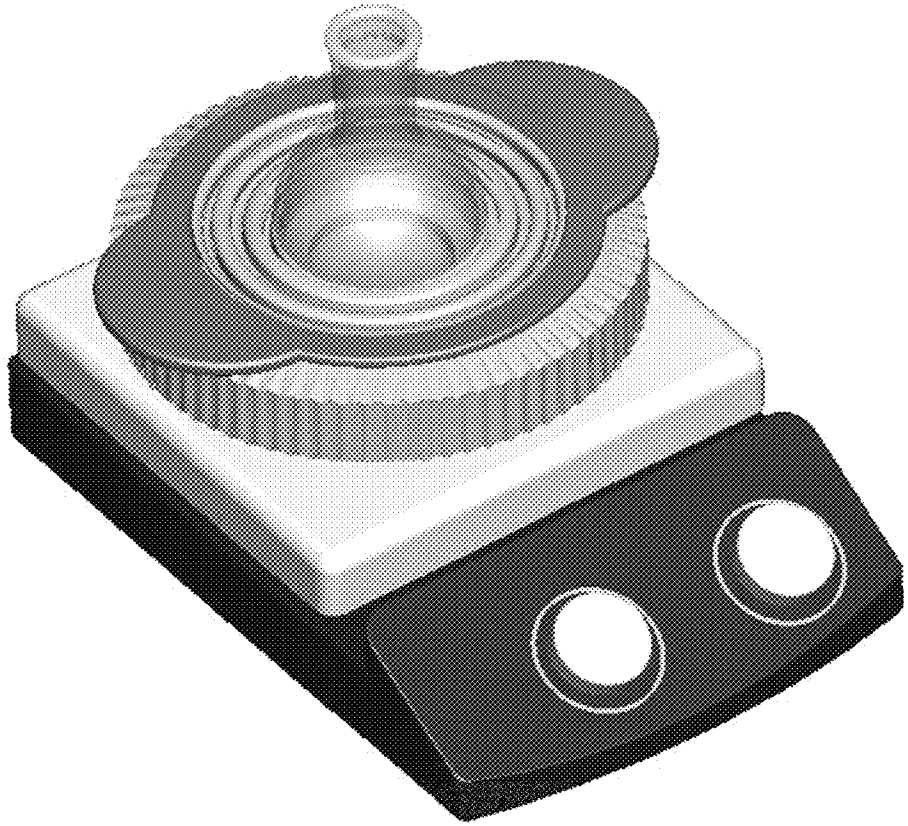

FIG. 3*a* and FIG. 3*b* illustrate one embodiment of the present invention in two of its four potential configurations/transformations. FIG. 3*a* illustrates the invention adapted for use with a 100 mL round-bottomed flask and FIG. 3*b* illustrates the invention adapted for use with a 1000 mL flask. FIG. 3*a* and FIG. 3*b* further illustrate the present invention in combination with hot plate stirrers and with round-bottomed flasks, thus showing the utility of the present invention as a means of heating rounded laboratory vessels.

Figure 4:
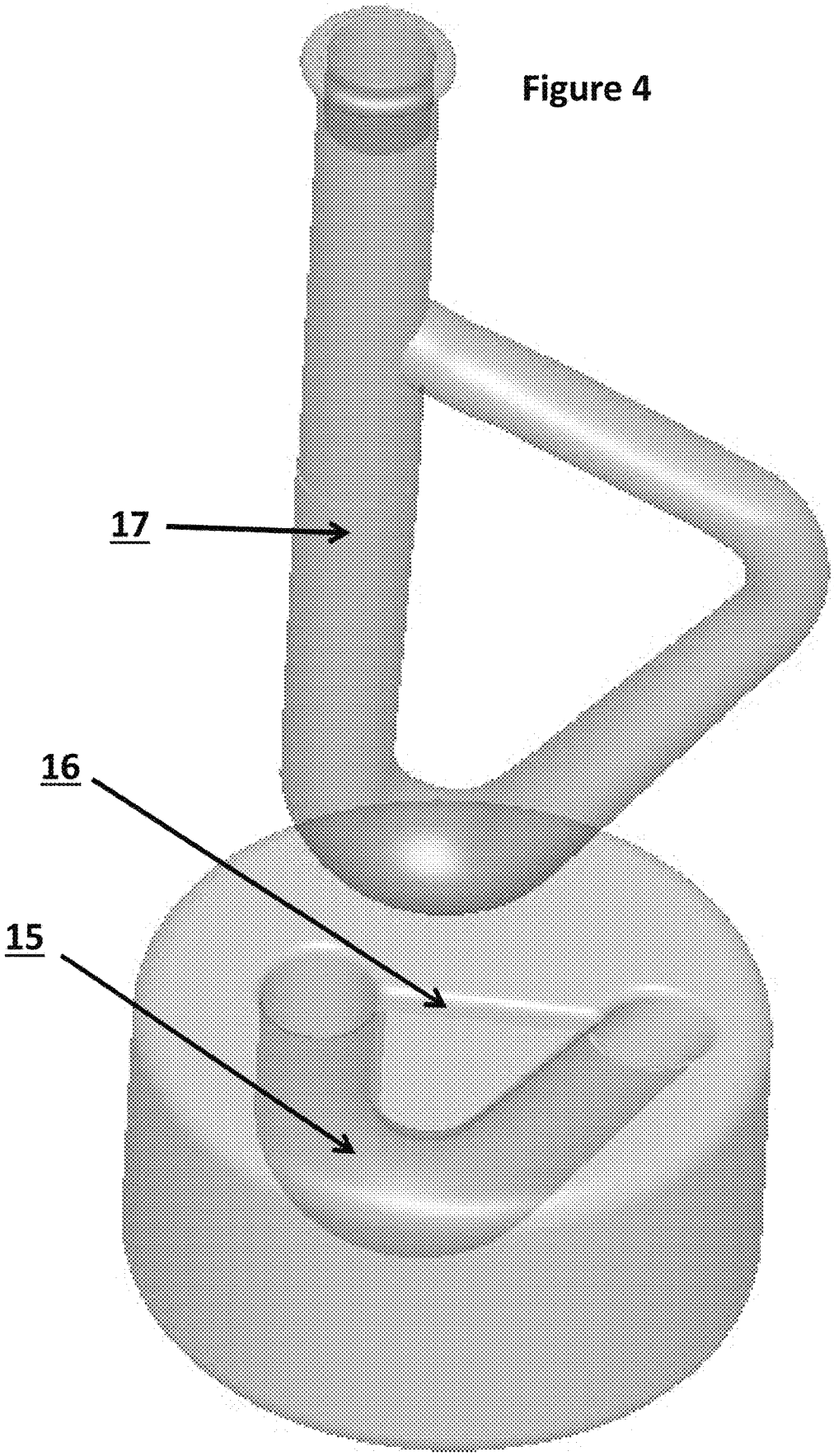
FIG. 4 is a top perspective view of a convertible hotplate adapter, in accordance with aspects of the present invention, and showing a container in position to be received thereby, in accordance with aspects of the present invention.

FIG. 4 illustrates another embodiment of the present invention. This embodiment of the present invention comprises a thermally conductive fluid within a thermally conductive skin and forms the overall shape of a truncated cylinder. This embodiment further comprises an angled U-tube-shaped pocket, 15, visibly emerging from the top face as two circular holes. This embodiment further comprises a slot or channel 16, about 5 mm in width, extending across the top face of the device from one hole to the other hole and further extending downward perpendicular to the top face, to a depth such that it merges with the U-shaped pocket, 15. As shown in FIG. 4, the effect of the overall shape of the U-shaped pocket in combination with the slot allows a Thiele tube 17, to be snuggly fitted into the device and supported in an upright position by the device.

Another embodiment of the present invention may comprise a thermocouple integrated with the device or inserted in slots or holes in the device such that the thermocouple probe may be plugged by means of a thermocouple pair of wires into the external temperature control of a hotplate or similar device.

Figure 5:
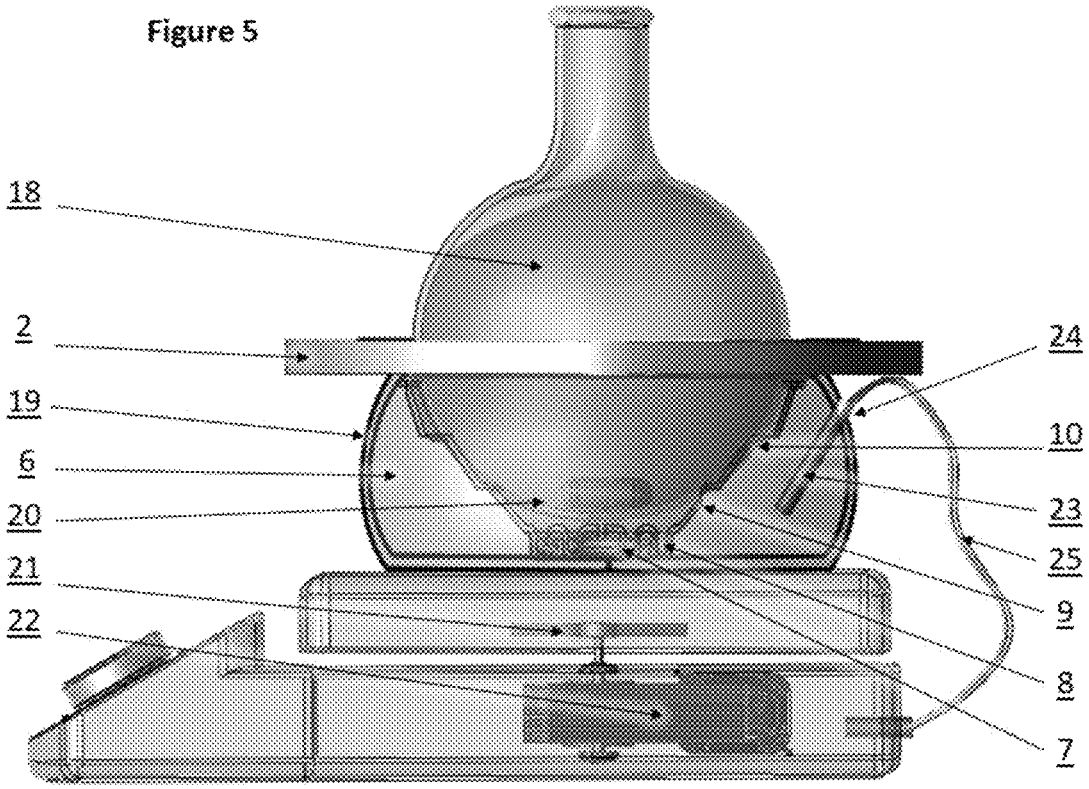
FIG. 5 is a transparent elevation view of the present invention comprising a polymeric heat-transfer device combined with a hotplate-magnetic stirring apparatus, and a magnetic follower, as used for heating and stirring the contents of a round-bottomed flask, in accordance with one embodiment of the present invention.

FIG. 5 illustrates one embodiment of the present invention by showing a transparent elevation view of the present invention as shown generally in FIG. 3*b*, including a combination with a round-bottomed flask 18; a follower magnet. 20, positioned inside the flask; a rotating magnet 21, positioned internal to the hotplate-magnetic-stirrer apparatus; and an electric motor 22 to turn the rotating magnet 21, also positioned within the hotplate-magnetic- stirrer apparatus. Another embodiment of the present invention may comprise a temperature sensing device, here depicted as a thermocouple, 23, integrated with the device or inserted in an orifice, 24 or slots or holes in the device such that the thermocouple probe, 23, may be plugged. by means of a thermocouple pair of wires, 25, into the external temperature control of a hotplate or similar device. FIG. 5 further illustrates the flexible polymeric support comprising a container, 19. containing a thermally-conductive fluid, 6.

While particular embodiments of the present invention have been illustrated and described, it would be obvious to those skilled in the art that various other changes and modifications can be made without departing from the spirit and scope of the invention. It is therefore intended to cover in the appended claims, which themselves constitute part of the disclosure, all such changes and modifications that are within the scope of this invention.

The following references are hereby incorporated herein by reference:

US PATENT DOCUMENTS

| | | |
|---|---|---|
| 3,784,170 | January 1974 | Peterson et al. |
| 4,054,270 | October 1977 | Gugger et al. |
| 4,080,663 | March 1978 | Wik |

-continued

| | | |
|---|---|---|
| 4,090,263 | May 1978 | Hoffa |
| 4,131,370 | December 1978 | Lawrence et al. |
| 4,199,265 | April 1980 | Sanderson et al. |
| 4,214,874 | July 1980 | White |
| 4,227,815 | October 1980 | Hoffa |
| 4,390,283 | June 1983 | Meyer |
| 4,568,195 | February 1986 | Herz et al. |
| 4,752,138 | June 1988 | Rufer |
| 4,759,635 | July 1988 | MacMichael et al. |
| 4,830,511 | May 1989 | Smazik |
| 4,876,069 | October 1989 | Jochimsen |
| 4,911,555 | March 1990 | Saffer et al. |
| 4,991,973 | February 1991 | Maaz et al. |
| 5,529,391 | June 1996 | Kindman et al. |
| 5,899,567 | May 1999 | Morris, Jr. |
| 5,911,503 | June 1999 | Braden et al. |
| D426312 | June 2000 | Gomes |
| 6,508,582 | January 2003 | Friedman |
| 6,659,637 | December 2003 | Friedman |
| 6,733,171 | May 2004 | Schob |
| 6,905,656 | June 2005 | Ladlow et al. |
| 6,962,433 | November 2005 | Nichols et al. |
| 6,988,825 | January 2006 | Coville et al. |
| 7,075,040 | July 2006 | McFadden et al. |
| 7,153,021 | December 2006 | Goodwin et al. |
| 7,364,350 | April 2008 | Coville et al. |
| 7,494,267 | February 2009 | Ware |
| 8,398,297 | March 2013 | Dettling et al. |
| 2004/0151065 | August 2004 | Nichols et al. |
| 2011/0038224 | February 2011 | Dettling et al. |

FOREIGN PATENT DOCUMENTS

| | | |
|---|---|---|
| 2 201 204 | May 1973 | DE |
| 81 06 555.8 | December 1981 | DE |
| 30 43 335 | June 1982 | DE |
| 1201297 | May 2002 | EP |
| 156206 | June 1969 | GB |
| WO 91/10503 | July 1991 | WO |

OTHER REFERENCES

Texas Instruments, Data Sheet for Single Schmitt-Trigger Inverter, SN74LVC1G14, SCE218C—April 1999—Revised February 2000, pp. 1-8, Texas Instruments, Dallas, Tex.

Allegro Microsystems, Inc., Data Sheet for Microstepping DMOS Driver with Translator, A3979, pp. 1-14, Allegro Microsystems, Inc., Worcester, Mass., www.allegromicro.com.

National Semiconductor Corporation, Data Sheet for LM117/LM317A/LM317 3—Terminal Adjustable Regulator, 9063, Oct. 20, 2008, pp. 1-28, National Semiconductor Americas Technical Support Center, www.national.com.

Linear Technology Corporation, Data Sheet for LTC1440/LTC1441/LTC1442 Ultralow Power Single/Dual Comparator with Reference, 144012fd, pp. 1-16, Linear Technology Corporation, Milpitas, Calif., www.linear.com, 1996.

Maxim Integrated Products, Data Sheet for MAX1615/MAX1616 High-Voltage, Low-Power Linear Regulators for Notebook Computers, 19/1225; Rev 3; September 2004, pp. 1-8, Maxim Integrated Products, Sunnyvale Calif., www.maxim-ic.com/packages.

International Search Report and Written Opinion mailed Jan. 4, 2012 for PCT/US2010/039614 filed Jun. 23, 2010.

International Preliminary Report on Patentability mailed Feb. 14, 2012 for PCT/US2010/039614 filed Jun. 23, 2010.

What is claimed is:

1. A device to facilitate the heating of rounded vessels and other rounded objects comprising:

a flexible polymeric support comprising:

a plurality of folds so as to form said flexible polymeric support into a plurality of nested, concentric hollow cylindrical portions each having respective upper edges and adapted to be arranged and fixed in at least two configurations such that said upper edges of said concentric hollow cylindrical portions accommodate at least two respective spherical section contours of at least two respective different sizes, and so as to be adapted to contact rounded vessels or other rounded objects of two respective different sizes.

2. The device according to claim 1 wherein said concentric hollow cylindrical portions comprise:

a heat-conducting polymeric material selected from the group consisting of heat- conducting silicone rubbers.

3. The device according to claim 1 additionally comprising:

a magnetic stirrer for creating a rotating magnetic field for purposes of stirring a vessel containing a magnet and disposed on said flexible polymeric support.

4. The device according to claim 1 additionally comprising:

a temperature-sensing device selected from the group consisting of thermometers and thermocouples.

5. A device to facilitate the heating of rounded vessels and other rounded objects comprising:

a flexible polymeric support comprising:

a plurality of folds so as to form said flexible polymeric support into a plurality of nested, concentric hollow cylindrical portions each having respective upper edges and adapted to be reversibly moved from a collapsed configuration wherein said upper edges are coplanar to a fixed configuration such that said upper edges of said hollow cylindrical portions accommodate the shape of a spherical section contour.

6. The device to facilitate the heating of rounded vessels and other rounded objects comprising:

a flexible polymeric support comprising:

a plurality of folds so as to form said flexible polymeric support into a plurality of nested, concentric hollow cylindrical portions each having respective upper edges and adapted to be reversibly moved between two deployed configurations such that said upper edges of said hollow cylindrical portions accommodate respectively the shapes of at least two different spherical section contours.

7. The device according to claim 1 wherein said flexible polymeric support comprises:

an upper side adapted to contact a container of one of said at least two spherical section contours and a lower side opposite said upper side, and additionally comprising a thermally conductive container disposed on said lower side of said flexible polymeric support, said thermally conductive container containing a thermally conductive filler material.

8. The device according to claim 5 wherein said flexible polymeric support comprises:

an upper side adapted to contact a container having a spherical section contour and a lower side opposite said upper side, and additionally comprising:

a container disposed on said lower side of said flexible polymeric support, said container containing a thermally conductive fluid.

9. The device according to claim 6 wherein said flexible polymeric support comprises:

an upper side adapted to contact a container of one of said at least two spherical section contours and a lower side opposite said upper side, and additionally comprising:

a container disposed on said lower side of said flexible polymeric support, said container containing a thermally conductive fluid.

10. A device according to claim 7. wherein said thermally conductive filler material is selected from the group consisting of liquids, pastes, putties, greases and gums.

11. A device according to claim 1 additionally comprising:

a handle portion.

12. A device according to claim 1 wherein said a flexible polymeric support comprises:

a flexible polymeric support surface comprising:

thermal interface silicone rubber compositions selected from the group consisting of silicone rubber compositions and fluoro-silicone rubber compositions, said thermal interface silicone rubber compositions containing substantially uniform dispersions of filler particles selected from the group consisting of thermally-conducting metals, minerals and ceramics.

13. A device according to claim 10 wherein said malleable material is selected from the group consisting of (a) high-temperature-resistant thermal-transfer fluids, silicone oil thermal transfer fluids and silicone fluids, (b) silicone greases and (c) silicone materials containing a substantially-uniform dispersion of thermally-conducting filler particles selected from particles of heat-conducting metals, mineral particles and ceramic particles.

14. A device according to claim 1, said device adapted to be arranged and fixed in four configurations such that said upper edges of said concentric hollow cylindrical portions accommodate respective round-bottomed flasks of four different respective different sizes at their respective bottoms.

* * * * *